US006845990B2

(12) United States Patent
van Egeraat

(10) Patent No.: US 6,845,990 B2
(45) Date of Patent: Jan. 25, 2005

(54) IN-LINE SKATE

(75) Inventor: Hendrikus Adrianus van Egeraat, Orebro (SE)

(73) Assignee: PC-Vane Sportartikel GmbH, Bremerhaven (DE)

( * ) Notice: Subject to any disclaimer, the term of this patent is extended or adjusted under 35 U.S.C. 154(b) by 54 days.

(21) Appl. No.: 10/299,194

(22) Filed: Nov. 19, 2002

(65) Prior Publication Data

US 2004/0094918 A1 May 20, 2004

(51) Int. Cl.[7] ..... A63C 17/04
(52) U.S. Cl. ..... 280/11.221; 280/11.27
(58) Field of Search ..... 280/11.227, 11.233, 280/11.25, 11.27, 11.19, 11.221, 11.222, 11.223, 11.231, 11.232, 11.226, 11.204, 11.224; 301/1, 114, 5.7, 105.1

(56) References Cited

U.S. PATENT DOCUMENTS 1,975,661 A * 10/1934 Powell ..... 280/11.27
3,885,804 A * 5/1975 Cudmore ..... 280/11.204
4,323,259 A * 4/1982 Boudreau ..... 280/11.233
5,303,940 A * 4/1994 Brandner ..... 280/11.223
5,566,957 A * 10/1996 Ho ..... 280/11.223
6,003,882 A * 12/1999 Colonese et al. ..... 280/11.231
6,173,975 B1 * 1/2001 Brandner ..... 280/11.223
6,398,230 B1 * 6/2002 Rudolph ..... 280/11.223

* cited by examiner

*Primary Examiner*—Hau Phan
(74) *Attorney, Agent, or Firm*—Whyte Hirschboeck Dudek SC

(57) ABSTRACT

An in-line skate includes a skate frame, front and rear wheels mounted rotatably on the skate frame, and a middle wheel assembly including at least two middle wheels, each of which is mounted rotatably on the skate frame between the front and rear wheels, is aligned with the front and rear wheels, and is rotatable about a rotation axis defined by the middle wheel. Each middle wheel further defines a wheel center and an inclined plane that passes through the wheel center and that is perpendicular to the rotation axis. The inclined plane is inclined relative to a vertical plane perpendicular to a ground plane by an acute angle. The front and rear wheels are inclined in the same direction as the middle wheels.

5 Claims, 7 Drawing Sheets

IN-LINE SKATE

BACKGROUND OF THE INVENTION

1. Field of the Invention

This invention relates to an in-line skate, more particularly to an in-line skate with inclined wheels that are inclined relative to a vertical plane.

2. Description of the Related Art

FIGS. 1 and 2 illustrate a conventional in-line skate disclosed in U.S. Pat. No. RE35,993. The in-line skate includes a frame 11, and front and rear wheels 12, 14 and a middle wheel 13 mounted rotatably on the frame 11. The front and middle wheels 12, 13 cooperatively define a first tangent plane 2 tangential to the bottoms of the front and middle wheels 12, 13. The rear and middle wheels 14, 13 cooperatively define a second tangent plane 2' tangential to the bottoms of the rear and middle wheels 14, 13. The first and second tangent planes form an obtuse angle in such a manner that either the front and middle wheels 12, 13 or the rear and middle wheels 14, 13 are simultaneously in rolling contact with the ground plane, which implies that the front and rear wheels 12, 14 cannot simultaneously contact the ground plane during skating. The construction of the aforesaid in-line skate is to achieve better cornering and high speeds. However the construction shortens the effective length of the wheelbase to about halve the skate length and it also reduces the number of wheels that engage the ground effectively and therewith the attainable speed. It is general knowledge that attainable speeds become higher with a longer wheelbase and a consecutive number of wheels that effectively engage the ground.

U.S. Pat. No. 6,398,230 discloses a modified v-line skate that includes a pair of first inclined wheels which are inclined in a first direction relative to a vertical plane, and a pair of second inclined wheels which are inclined in a second direction opposite to the first direction. The first and second inclined wheels are alternately aligned in a longitudinal direction. The aforesaid v-line skate is disadvantageous in that only one of the pairs of the first and second inclined wheels will be in rolling contact with the ground plane during the pendulous skating motion, i.e., when the skater leans toward the first direction, only the first inclined wheels will be in effective rolling contact with the ground plane, and when the skater leans toward the second direction, only the second inclined wheels will be in effective rolling contact with the ground plane.

The disclosures of the aforesaid patents are incorporated herein with reference.

SUMMARY OF THE INVENTION

The object of the present invention is to provide an in-line skate with inclined wheels for achieving a long wheelbase and effective ground contact on all wheels for high speeds, when unusually one foot at the time engages the ground and a short wheelbase when maneuvering at reduced speeds, when usually both feet engage the ground simultaneously better cornering.

According to the present invention, there is provided an in-line skate that comprises: a skate frame having front and rear ends; a front wheel mounted rotatably on the skate frame adjacent to the front end of the skate frame; a rear wheel mounted rotatably on the skate frame adjacent to the rear end of the skate frame; and a middle wheel assembly including at least two middle wheels, each of which is mounted rotatably on the skate frame between the front and rear wheels, each of which is aligned with the front and rear wheels in a longitudinal direction, and each of which is rotatable about a first rotation axis defined by the middle wheel. Each of the middle wheels further defines a first wheel center and a first inclined plane that passes through the first wheel center and that is perpendicular to the first rotation axis. The first inclined plane is inclined relative to a vertical plane perpendicular to a ground plane by a first acute angle. The front and rear wheels define second and third rotation axes, second and third wheel centers, and second and third inclined planes, respectively. The second and third inclined planes pass through the second and third wheel centers, are perpendicular to the second and third rotation axes, and are inclined relative to the vertical plane by second and third acute angles, respectively. The first, second, and third inclined planes are inclined relative to the vertical plane in the same direction.

BRIEF DESCRIPTION OF THE DRAWINGS

In drawings which illustrate an embodiment of the invention.

DETAILED DESCRIPTION OF THE PREFERRED EMBODIMENT

Figure 1:
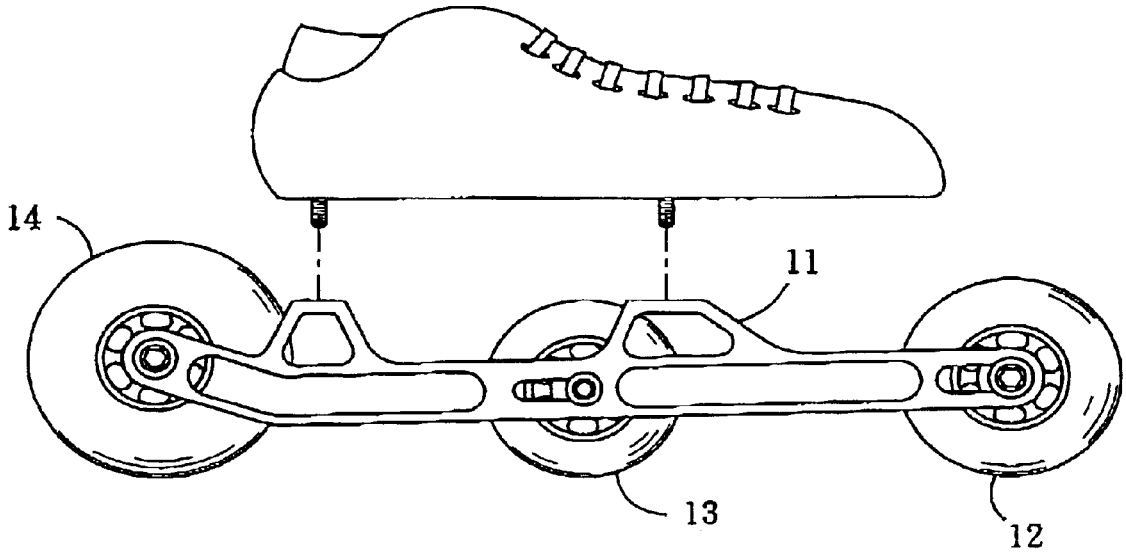
FIG. 1 PRIOR ART
FIG. 1 is a side view of a conventional in-line skate.
Figure 2:
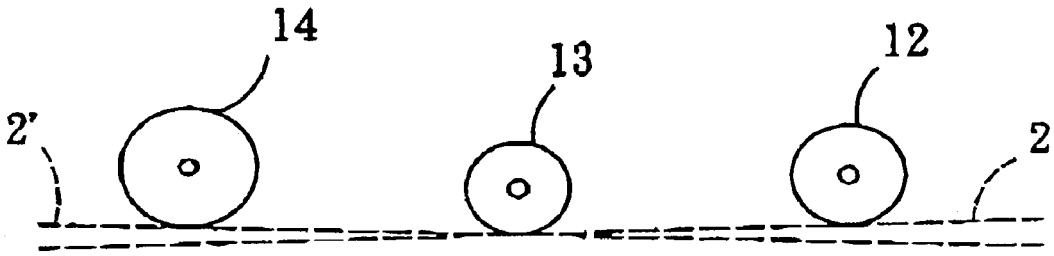
FIG. 2 PRIOR ART
FIG. 2 is a schematic side view illustrating two intersecting tangent planes defined respectively by the wheels of the in-line skate of FIG. 1.
Figure 3:
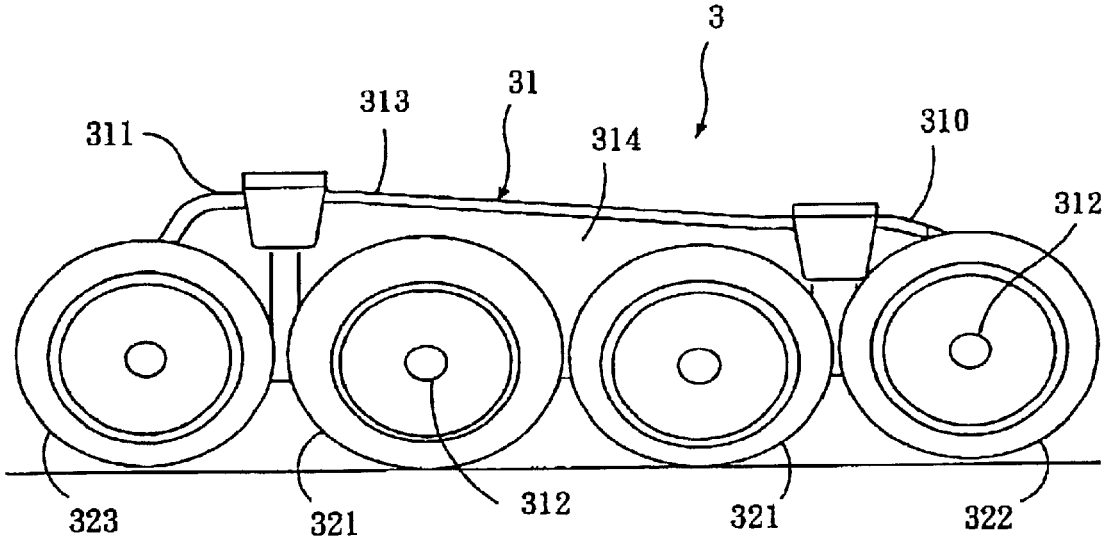
FIG. 3 is a schematic side view of an in-line skate embodying this invention.
Figure 4:
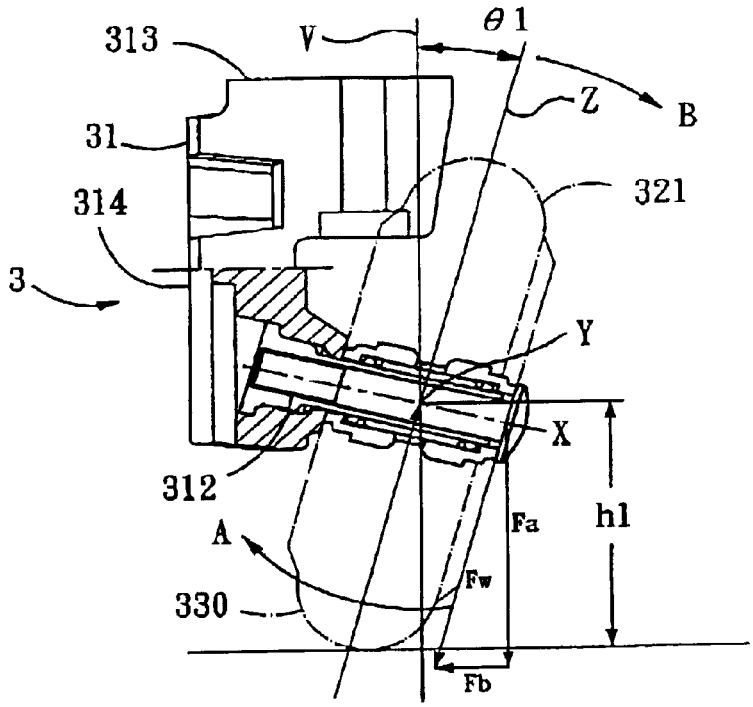
FIG. 4 is a schematic sectional view of the in-line skate of FIG. 3 to illustrate a middle wheel that is inclined relative to a vertical plane perpendicular to a ground plane by a first acute angle.
Figure 5:
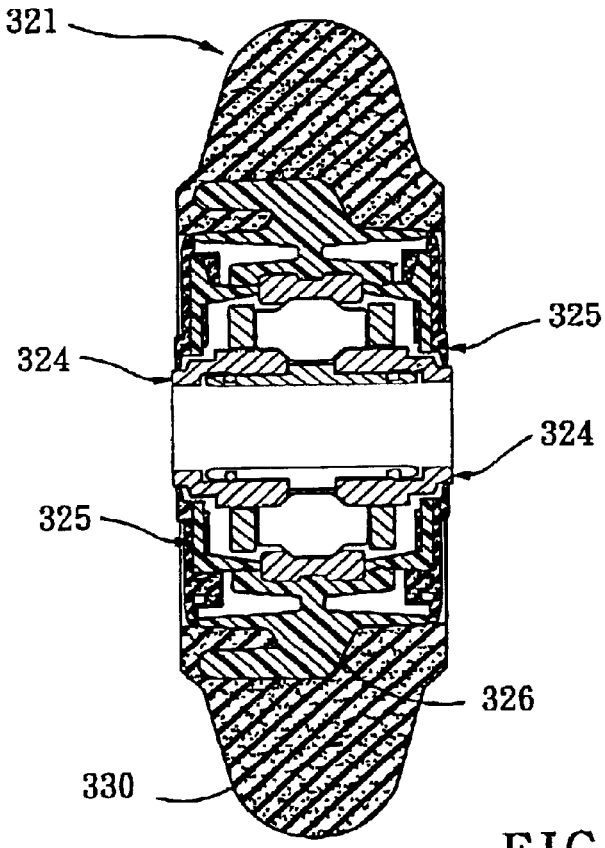
FIG. 5 is a sectional view of the middle wheel of the in-line skate of FIG. 3.

FIGS. 3 to 5 illustrate a preferred embodiment of an in-line skate 3 of this invention that includes: a skate frame 31 having front and rear ends 310, 311; a front wheel 322 mounted rotatably on the skate frame 31 adjacent to the front end 310 of the skate frame 31; a rear wheel 323 mounted rotatably on the skate frame 31 adjacent to the rear end 311 of the skate frame 31; and a middle wheel assembly including at least two juxtaposed middle wheels 321, each of which is mounted rotatably on the skate frame 31 between the front and rear wheels 322, 323, each of which is aligned with the front and rear wheels 322, 323 in a longitudinal direction, and each of which is rotatable about a first rotation axis (X) defined by the middle wheel 321. Each of the middle wheels 321 further defines a first wheel center (Y) and a first inclined plane (Z) that passes through the first wheel center (Y) and that is perpendicular to the first rotation axis (X). The first inclined plane (Z) is inclined relative to a vertical plane (V) perpendicular to a ground plane by a first acute angle (θ1) so that the sliding friction between the middle wheels 321 and the ground plane during skating can be reduced. As illustrated in FIG. 4, when an external force ($F_w$) is applied to each of the middle wheels 321, the resulting friction during skating is proportional to the component ($F_a$) of the external force ($F_w$) normal to the ground plane. As a consequence, the friction can be reduced during skating by designing an inline skate with an inclined wheel in a manner shown in FIG. 4, thereby resulting in a higher speed than that of a conventional in-line skate. Another component ($F_b$) of the external force ($F_w$) aids bending of a ground-contacting portion 330 of a tire of the middle wheel 321 in a direction toward the frame 31 (indicated as arrow (A) in FIG. 4) and will add considerable momentum to the kick off.

Figure 6:
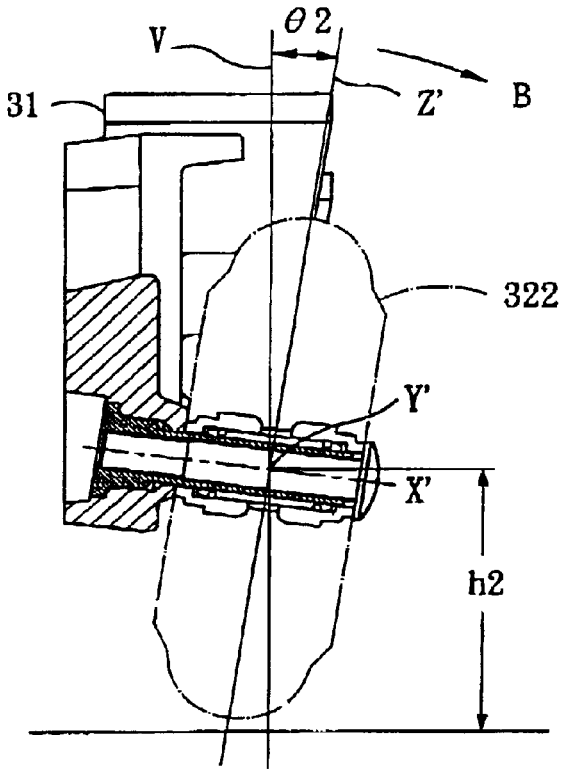
FIG. 6 is a schematic sectional view of the in-line skate of FIG. 3 to illustrate a front wheel that is inclined relative to the vertical plane by a second acute angle.
Figure 7:
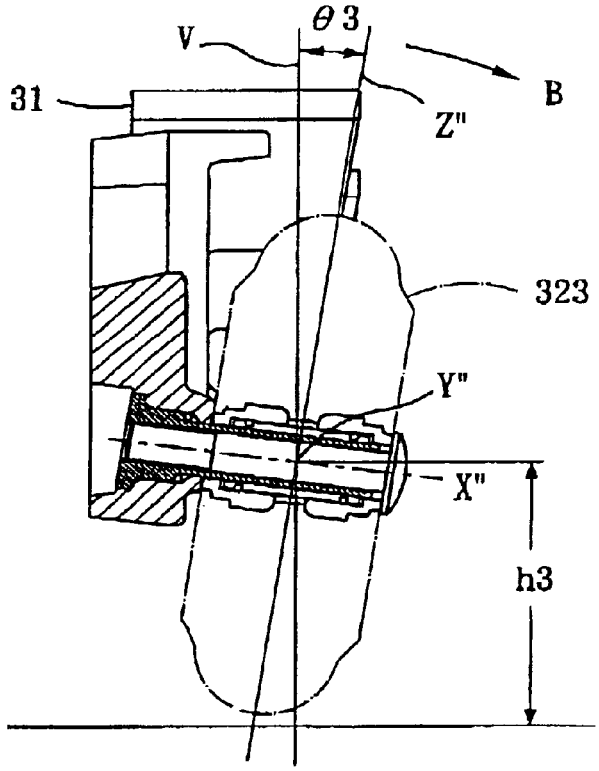
FIG. 7 is a schematic sectional view of the in-line skate of FIG. 3 to illustrate a rear wheel that is inclined relative to the vertical plane by a third acute angle.

Referring now to FIGS. 6 and 7, in combination with FIG. 4, the front and rear wheels 322, 323 define second and third rotation axes (X', X"), second and third wheel centers (Y', Y"), and second and third inclined planes (Z', Z"), respectively. The second and third inclined planes (Z', Z") pass through the second and third wheel centers (Y', Y"), are perpendicular to the second and third rotation axes (X', X"), and are preferably inclined relative to the vertical plane (V) by second and third acute angles (θ2, θ3), respectively. The first, second, and third inclined planes (Z, Z', Z") are inclined relative to the vertical plane (V) in a clockwise direction (indicated as arrow (B) in FIGS. 4, 6 and 7). The aforesaid clockwise direction is based on the condition that the in-line skate 3 shown in FIG. 4 is a right-foot in-line skate. With a left-foot in-line skate, the first, second, and third inclined planes (Z, Z', Z") are inclined relative to the vertical plane (V) in a counterclockwise direction.

The second and third acute angles (θ2, θ3) are preferably smaller or bigger than the first acute angle (θ1, when the wheels are placed at different heights from the ground plane or equal when all wheels are at the same height from the ground). Allowing the force $F_w$ to bend the wheels with the biggest acute angle easier than the ones with the lesser acute angle (so as to enhance stability during skating).

Figure 8:
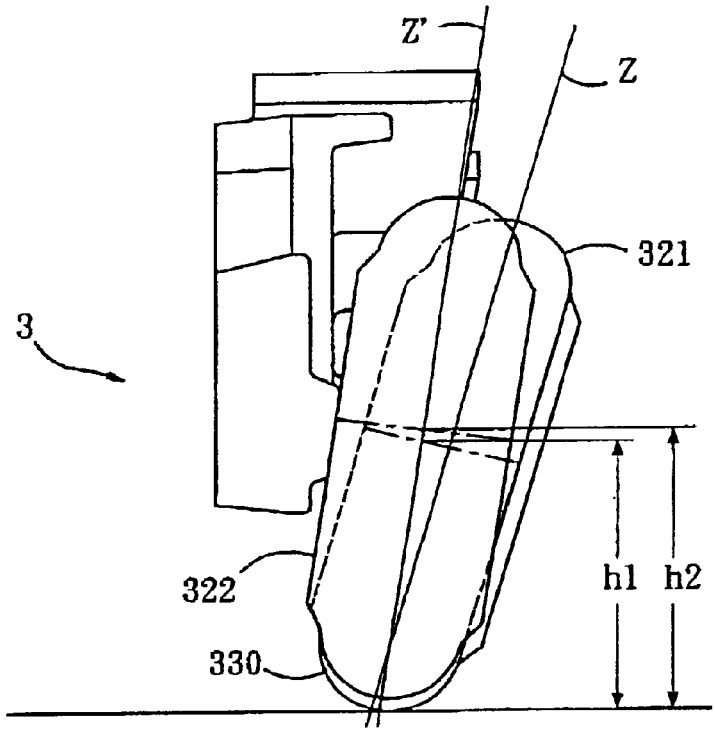
FIG. 8 is a schematic view to illustrate heights of the front and middle wheels of the in-line skate of FIG. 3, with the middle wheel contacting the ground plane.
Figure 9:
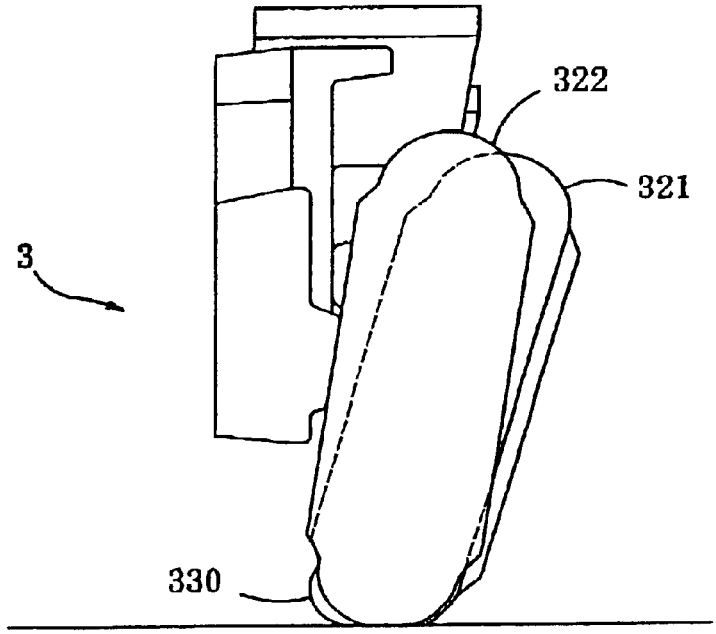
FIG. 9 is a schematic view to illustrate heights of the front and middle wheels of the in-line skate of FIG. 3, with the front and middle wheels simultaneously contacting the ground plane.

Referring now to FIGS. 8 and 9, in combination with FIGS. 4, 6 and 7, the middle wheel 321 and the front and rear wheels 322, 323 further define first, second, and third vertical heights (h1, h2, h3) measured from the first, second, and third wheel centers (Y, Y', Y") to the ground plane, respectively. The second and third vertical heights (h2, h3) are higher than the first height (h1), and are preferably equal.

Since the first, second, and third inclined planes (Z, Z', Z") are inclined relative to the vertical plane (V) in the same direction (the aforesaid clockwise direction (B)), the front and rear wheels 322, 323 together with the middle wheels 321 can be simultaneously in rolling contact with the ground plane especially so when the weight of a skater is concentrated on one foot. As illustrated in FIG. 9, the ground contacting portion 330 of the tire of each of the middle wheels 321 is bent under tension to an extent that the height of the in-line skate 3 is lowered to a position, where the front and rear wheels 322, 323 and the middle wheels 321 are simultaneously in rolling contact with the ground plane, thereby resulting in an increase in contact length of the in-line skate 3, and thus resulting in an increase in speed.

The thickness of the tire of each of the front and rear wheels 322, 323 and the middle wheels 321 preferably varies with the weight of the user so as to provide the tire with desired deformability during skating.

Referring back to FIGS. 3 to 5, the skate frame 31 includes a top plate 313 extending in the longitudinal direction and having two opposite sides, and a bracket 314 extending downwardly from one of the sides of the top plate 313 in a direction parallel to the vertical plane (V). The in-line skate 3 further includes a plurality of bearings 324 (only one is shown) respectively received in annular hubs 326 (only one is shown) of the middle wheels 321 and the front and rear wheels 322, 323, and a plurality of axles 312 (only one is shown) respectively extending through the bearings 324 and secured to and projecting inclinedly and downwardly from the bracket 314 toward the other one of the sides of the top plate 31. The middle wheels 321 and the front and rear wheels 322, 323 are journalled to the axles 312 through the bearings 324, respectively. A pair of sealing members 325 are mounted on two opposite ends of each of the axles 312 so as to seal gaps between the respective hub 326 and the respective bearing 324 and between the respective axle 312 and the respective bearing 324 and so as to prevent dust from entering into the gaps. Each axle 312 extends through the respective sealing members 325.

Figure 10:
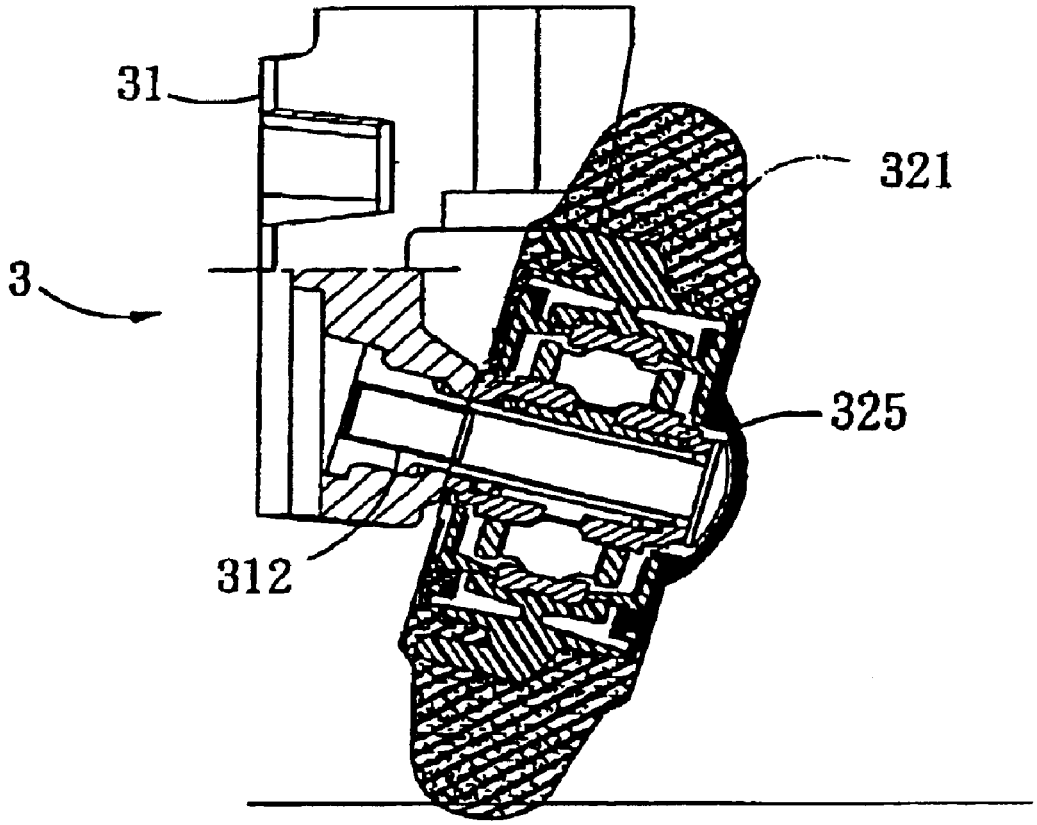
FIG. 10 is a sectional view to illustrate a sealing member modified from that shown in FIG. 3.

FIG. 10 illustrates a modified sealing member 325 which is similar to those shown in FIG. 5, except that the modified sealing member 325 additionally and sealingly covers one end of the respective axle 312.

By virtue of the construction of the middle wheels 321 of the in-line skate 3, higher speed and better cornering can be achieved.

With the invention thus explained, it is apparent that various modifications and variations can be made without departing from the spirit of the present invention. It is therefore intended that the invention be limited only as recited in the appended claims.

I claim:

1. An in-line skate comprising:

a skate frame having front and rear ends;

a front wheel mounted rotatably on said skate frame adjacent to said front end of said skate frame; a rear wheel rotatably mounted on said skate frame adjacent to said rear end of said skate frame; and a middle wheel assembly including at least two middle wheels, each of which is mounted rotatably on said skate frame between said front and rear wheels, each of which is aligned with said front and rear wheels in a longitudinal direction, and each of which is rotatable about a first rotation axis defined by said middle wheel, each of said middle wheels further defining a first wheel center and a first inclined plane that passes through said first wheel center and that is perpendicular to said first rotation axis, said first inclined plane being inclined relative to a vertical plane perpendicular to a ground plane by a first acute angle;

wherein said front and rear wheels define second and third rotation axes, second and third wheel centers, and second and third inclined planes, respectively, said second an third inclined planes passing through said second and third wheel centers, said second and third inclined planes also being perpendicular to said second and third rotation axes, and said second and third inclined planes further being inclined relative to the vertical plane by second and third acute angles, respectively, said second and third acute angles smaller than said first acute angle, said first, second, and third inclined planes being inclined relative to the vertical plane in the same direction; and wherein said middle wheels and said front and rear wheels further define first, second, and third vertical heights that are respectively measured said first, second, and third wheel centers to the ground plane, said second and third vertical heights being higher than said first height.

2. The in-line skate of claim 1, wherein said second and third vertical heights are equal.

3. The in-line skate of claim 1, wherein said skate frame includes a top plate extending in said longitudinal direction and having two opposite sides, and a bracket extending downwardly from one of said sides of said top plate in a direction parallel to the vertical plane, said in-line skate further comprising a plurality of bearings that are respectively received in said middle wheels and said front and rear wheels, and a plurality of axles extending respectively through said bearings, and secured to and projecting inclined and downwardly from said bracket toward the other one of said sides of said top plate, said middle wheels and said front and rear wheels being journalled to said axles by said bearings, respectively.

4. The in-line skate of claim 3, each of said axles has two opposite ends, each of said front and rear wheels and said middle wheels including a hub surrounding and connected to a respective one of said bearings, said in-line skate further comprising a pair of sealing members mounted on said opposite ends of each of said axles so as to seal gaps between said hub of a respective one of said front and rear wheels and said middle wheels and a respective one of said bearings and between a respective one of said axles and the respective one of said bearings.

5. The in-line skate of claim 3, wherein each of said axles has two opposite ends, each of said front and rear wheels and said middle wheels including a hub surrounding and connected to a respective one of said bearings, said in-line skate further comprising a pair of sealing members mounted on said opposite ends of each of said axles so as to seal gaps between said hub of a respective one of said front and rear wheels and said middle wheels and a respective one of said bearings and between a respective one of said axles and the respective one of said bearings, said sealing members covering said opposite ends of the respective one of said axles.

* * * * *